US006003529A

United States Patent [19]

Perry, Jr.

[11] Patent Number: 6,003,529

[45] Date of Patent: Dec. 21, 1999

[54] DISH MACHINE/POT WASHER

[75] Inventor: Hubert A. Perry, Jr., Wellesley, Mass.

[73] Assignee: Adamation, Inc., Newton, Mass.

[21] Appl. No.: 08/940,505

[22] Filed: Sep. 30, 1997

[51] Int. Cl.[6] ..... B08B 3/02

[52] U.S. Cl. ..... 134/56; 134/199; 134/131; 251/326

[58] Field of Search ..... 134/56 D, 176, 134/179, 199, 57 D, 58 D, 131, 64 R, 122 R; 239/578, 443; 251/326, 232; 137/883

[56] References Cited

U.S. PATENT DOCUMENTS

| | | | |
|---|---|---|---|
| 1,559,727 | 11/1925 | Merseles | 134/199 |
| 1,698,858 | 1/1929 | Smith . | |
| 2,154,559 | 4/1939 | Blide | 141/9 |
| 2,842,144 | 7/1958 | Lyman | 134/57 |
| 3,181,541 | 5/1965 | Brooking | 134/186 |
| 3,277,906 | 10/1966 | Goldman | 134/57 |
| 3,586,011 | 6/1971 | Mazza . | |
| 3,648,931 | 3/1972 | Jacobs . | |
| 3,951,683 | 4/1976 | Jarvis, Jr. et al. . | |
| 4,066,472 | 1/1978 | Perry . | |
| 4,094,702 | 6/1978 | Rabuffetti | 134/10 |
| 4,177,534 | 12/1979 | Lanzisera . | |
| 4,402,331 | 9/1983 | Taldo | 134/58 R |
| 5,131,419 | 7/1992 | Roberts . | |
| 5,331,986 | 7/1994 | Lim et al. . | |
| 5,439,198 | 8/1995 | Reed | 251/231 |
| 5,449,146 | 9/1995 | Weagraff | 251/326 |
| 5,494,062 | 2/1996 | Springer | 134/58 D |
| 5,507,877 | 4/1996 | Magsig | 134/18 |
| 5,515,268 | 5/1996 | Yoda . | |
| 5,759,289 | 6/1998 | Caron | 134/34 |
| 5,820,106 | 10/1998 | Wurangian | 251/326 |
| 5,855,357 | 1/1999 | Gunder | 251/326 |

*Primary Examiner*—Frankie L. Stinson
*Attorney, Agent, or Firm*—Samuels, Gauthier & Stevens

[57] ABSTRACT

In a warewashing machine, a power wash zone is adapted to function either in a pot washing mode or in a warewashing mode. A valve controls the flow of water into an upper manifold. In the pot washing mode when the flow of water into the upper manifold is decreased, the flow into a lower manifold is correspondingly increased. This results in an increase flow rate and pressure striking a pot.

4 Claims, 2 Drawing Sheets

DISH MACHINE/POT WASHER

FIELD OF THE INVENTION

In a warewashing system, a single wash zone operates in either a warewashing mode or a pot washing mode.

BACKGROUND OF THE INVENTION

Description of Related Art

In commercial warewashing (dishwashing systems such as sold to hotels, resorts, universities and the like) there are typically several zones through which passes dishes, glasses, flatware, etcetera to be cleaned. For example, there may be circulating pre-wash, high power pre-wash, power wash, power pre-rinse and final rinse. Typically, in commercial establishments, pots are either washed by hand or, more likely, in a separate pot washing machine. For cleaning pots in a machine, a much higher pressure is needed to properly clean or scour the inside of the pot compared to lower pressure that is used for dishes. Therefore, in a commercial establishment, a separate pot washing machine must be utilized.

U.S. Pat. No. 5,131,419, Roberts, recognized this problem, namely that a single washing apparatus should be able to function in multiple modes and particularly be interchangeable between a warewashing mode and a pot washing mode. However, as disclosed in Roberts, a relatively complex control system was necessary to achieve this result.

SUMMARY OF THE INVENTION

The present invention modifies an existing power wash zone of a commercial warewasher in order to operate that zone between a ware wash mode and a pot washing mode.

Broadly, the invention comprises an adjustable valve incorporated into the wash zone of a commercially available warewasher. This results in a combined dish machine/pot washer.

In a prior art power wash zone, the zone comprises a back wall, a top, a front wall and a floor. Racks carrying dishes and the like are transported through the zone. There are upper and lower water manifolds, each manifold having an array of nozzles to direct water onto the articles being washed. A riser, usually located outside the back wall of the power wash zone, carries the water for the upper and lower manifolds. To connect the riser to the manifolds, rectangular fittings are typically used which pass through the back wall of the housing and connect to the upstream ends of the upper and lower manifolds and are secured thereto in a fluid tight manner.

In the present invention, a valve is secured in the fluid flow path of the water flowing through the riser and into the upper manifold. In a preferred embodiment, the valve is secured, at least in part, to the fitting. In a particularly preferred embodiment, the valve is secured at the interface of the fitting and the upper manifold.

The valve is a variable valve which controls the flow rate of the water to the upper manifold between fully open, fully closed or any flow rate therebetween.

Broadly, the valve comprises a back plate having an orifice in registration with the fluid flow path of the water flowing into the upper manifold. A guide plate is joined to the back plate. The guide plate is characterized by a slot, a portion of the slot in registration with the orifice of the back plate. A slide plate is received in the slot and is adapted to reciprocate therein to vary the flow rate of the water flowing into the upper manifold. Preferably, the reciprocation of the slide plate is effected by mechanical linkage.

DESCRIPTION OF THE PREFERRED EMBODIMENT(S)

Figure 1:
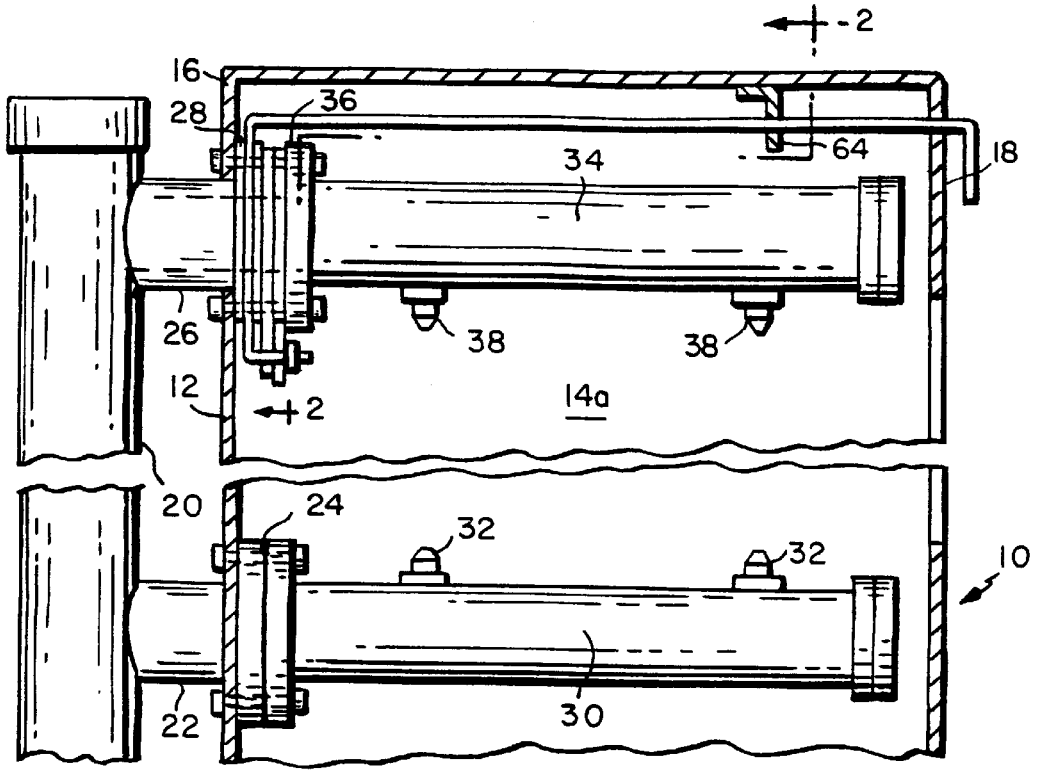
FIG. 1 is a side schematic illustration of an embodiment of the invention in a prior art power wash zone of a conventional warewasher.

Referring to FIG. 1, the housing of a prior art warewasher wash zone is shown generally at 10 and comprises a back wall 12, side walls 14*a* and 14*b* (not shown), a top 16 and a front wall 18.

A riser 20 is located adjacent the back wall 12 and has a lower connector 22 with a flange 24 and an upper connector 26 with a flange 28. The lower connector 22 passes through the wall 12 and is secured to the upstream end of a manifold 30 in a fluid-tight manner. Various spray nozzles for directing spray upwardly are shown generally at 32. The upper connector 26, joined to the riser 20, also passes through the back wall 12. The connector 26 is joined to an upper manifold 34 having a flange 36.

Various spray nozzles for directing spray are shown generally at 38.

Figure 2:
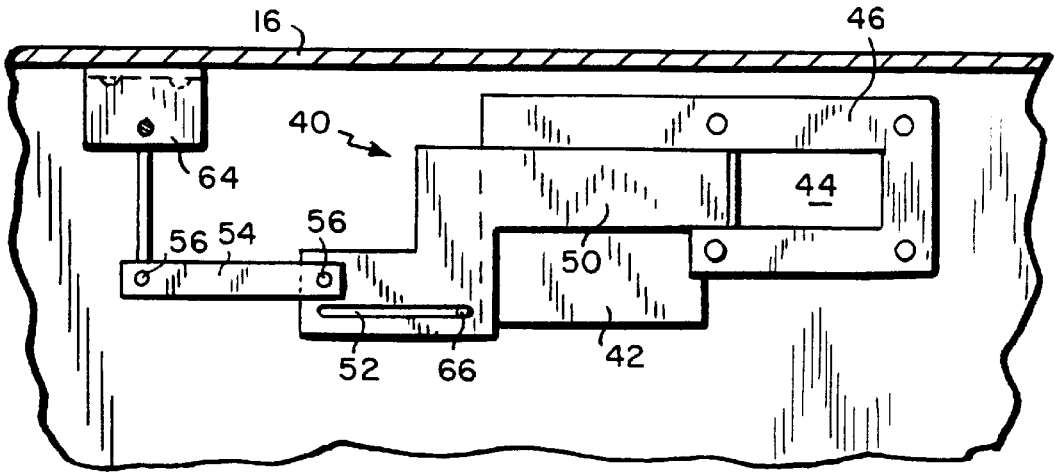
FIG. 2 is a front view of FIG. 1 taken along lines 2—2.
Figure 3:
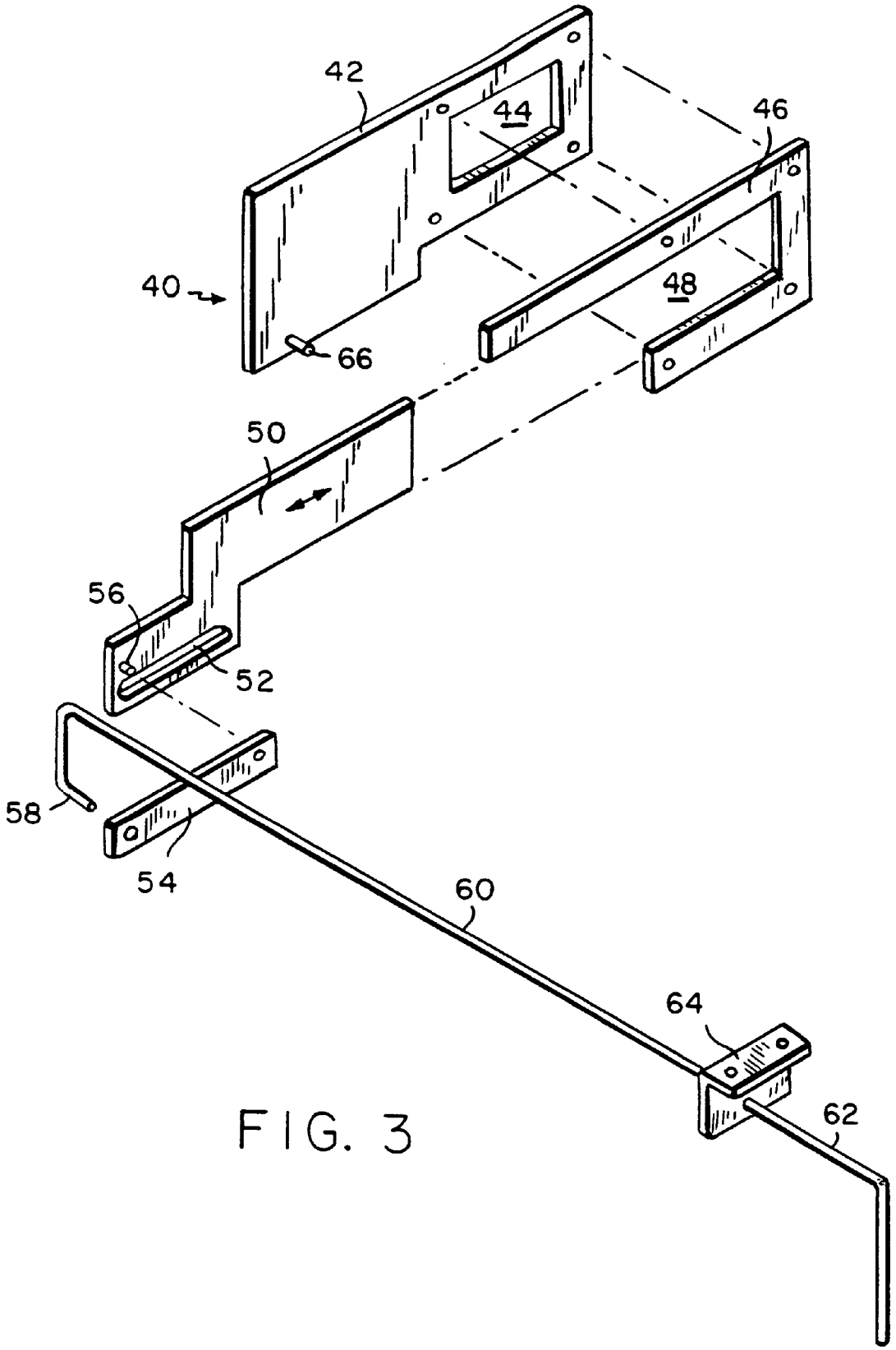
FIG. 3 is an exploded perspective view of the valve of FIGS. 1 and 2.

Referring to FIGS. 2 and 3, a valve assembly 40 comprises a back plate 42 characterized by an orifice 44 which is dimensionally the same as the orifice of the connector 26 which connector would ordinarily connect directly to the flange 36 of the upper manifold 34. A guide plate 46 is characterized by a slot 48, at least a portion of the slot 48 in registration with the orifice 44. A slide plate 50 reciprocates in the slot 48.

When assembled, the valve 40 is sandwiched between the flange 28 of the connector 26 and the flange 36 of the upper manifold 34. Specifically, they are secured as flange 28/back plate 42/guide plate 46/flange 36.

The slider plate 50 is characterized by a slot 52. A linkage bar 54 at one end is rotatably pinned to a post 56. The other end of the linkage bar 54 is rotatably pinned to one end 58 of a handle 60. The other end 62 of the handle 60 is secured to a rod handle support plate 64 which is secured to the underside of the top 16 of the wash zone 10. A post 66 on the back plate 52 registers with the slot 52 and limits the travel of the plate 50.

As can be seen from FIG. 3, the slider plate can be varied to either completely opened, completely closed or provide any size opening therebetween to control the flow rate of the water into the upper manifold.

In the warewashing mode the flow rate and pressure of the water from the upper and lower manifolds 30 and 34 is essentially uniform. In the potwashing mode, the orifice 44 moved to restrict the orifice 44. There is an increase in the flow rate and pressure of water flowing from the lower manifold to clean the pot. If the pressure is too great and causes the pot to dislodge the slide plate 50 can be partially opened and the spray from the upper manifold will prevent dislodgement of the pot.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention, what I now claim is:

1. In a warewashing system having a wash zone, the zone defined in part by a wall, the zone having an upper manifold and a lower manifold, each of the manifolds having a spray nozzle(s), a common riser secured to the wall and a connector joined to the riser and in fluid flow communication with the nozzles to carry water to the nozzles, the improvement which comprises:

a backplate secured to the wall, the backplate characterized by an opening which opening is in fluid flow communication with the riser and the nozzle(s), a valve secured to the connector, the valve comprising a guide plate characterized by a slot in registration with the opening, a slide plate received in the slot, the slide plate adapted for reciprocal movement within the slot whereby the fluid flow rate in the upper manifold can be varied.

2. The system of claim 1 wherein the valve is positioned upstream of the upper manifold.

3. The system of claim 1 wherein the slide plate comprises one end received in the guide plate and another end has a mechanical linkage secured to the other end to effect the reciprocating motion.

4. The system of claim 3 wherein the mechanical linkage comprises a handle having one end rotatably secured to the other end of the slide plate and the other end of the handle rotatably secured to the wash zone whereby rotation of the handle effects the reciprocating action of the slide plate.

* * * * *